US005816484A

United States Patent [19]

Buchalski et al.

[11] Patent Number: 5,816,484

[45] Date of Patent: Oct. 6, 1998

[54] FOOD CONTAINER

[75] Inventors: Brian J. Buchalski, Hamilton Square; Wai Fun Cheng; Nelson Young, both of Livingston; Michael Lai, Edison, all of N.J.

[73] Assignee: WY Industries, Inc., North Bergen, N.J.

[21] Appl. No.: 712,154

[22] Filed: Sep. 11, 1996

[51] Int. Cl.[6] ..... B65D 5/46

[52] U.S. Cl. ..... 229/117.15; 206/519; 220/770; 229/114; 229/155

[58] Field of Search ..... 229/114, 117.13, 229/117.14, 117.15, 155, 911; 220/339, 770, 771; 206/519

[56] References Cited

U.S. PATENT DOCUMENTS

| | | | |
|---|---|---|---|
| 2,808,976 | 10/1957 | Chaplin . | |
| 3,104,795 | 9/1963 | Adams | 229/155 |
| 3,156,371 | 11/1964 | Harrison . | |
| 3,282,462 | 11/1966 | Box . | |
| 3,445,052 | 5/1969 | Lewallen . | |
| 3,790,064 | 2/1974 | Kramer | 229/155 |
| 3,900,550 | 8/1975 | Oliver et al. | 220/339 |
| 3,907,193 | 9/1975 | Heller | 220/339 |
| 3,933,296 | 1/1976 | Ruskin et al. | 220/339 |
| 3,960,289 | 6/1976 | Panicci . | |
| 4,003,515 | 1/1977 | Steele | 229/114 |
| 4,231,476 | 11/1980 | Compton et al. . | |
| 4,478,348 | 10/1984 | Cook . | |
| 4,529,092 | 7/1985 | Swingley, Jr. | 206/519 |
| 4,534,466 | 8/1985 | Wood . | |
| 5,123,540 | 6/1992 | Karavias | 220/339 |
| 5,358,175 | 10/1994 | Cai | 229/911 |
| 5,489,063 | 2/1996 | Buchalski et al. . | |
| 5,607,075 | 3/1997 | Burgdorf | 206/519 |

FOREIGN PATENT DOCUMENTS

| | | | |
|---|---|---|---|
| 2027475 | 10/1971 | Germany | 229/117.15 |
| 509273 | 7/1939 | United Kingdom | 229/117.13 |

*Primary Examiner*—Gary E. Elkins
*Attorney, Agent, or Firm*—William Squire

[57] ABSTRACT

A thermoplastic molded or formed container has four trapezoidal walls that incline upwardly and outwardly upstanding from a bottom wall to create a top opening that is larger than the bottom wall. Each side wall has a closure flap that is connected to it at an upper edge by a living hinge. A locking handle member in the shape of a loop with locking extensions extends from an edge of one flap and engages a slot in an opposite flap. The handle member is a loop with locking projections which engage the opposite flap surface, the handle member passing through the slot for manually grasping. The container may be square or rectangular in transverse section or a combination thereof with a conical truncated section.

14 Claims, 2 Drawing Sheets

FOOD CONTAINER

BACKGROUND OF THE INVENTION

This invention relates to food containers, and, more particularly, to molded thermoplastic food containers.

Of interest is commonly owned U.S. Pat. No. 5,489,063 in the name of the present inventors and incorporated by reference herein.

Food containers made from folded cardboard—such as SBS or bleached board—or similar paper-like materials are known. For example, see U.S. Pat. No. 1,088,964. Once the cardboard has been appropriately folded, the resulting container typically includes a flat bottom surrounded by four sloped upstanding side walls, the upper edges of which define an opening which is above and opposite the flat bottom. The opening is closeable by four flaps each of which is connected to the upper edge of one of the side walls.

The flaps are outwardly folded to expose the opening to permit placement of food into the container. Thereafter, the flaps are inwardly folded to cover and close the opening. One of the flaps may include a slit or slot near its free edge and the diametrically opposed flap may include a tab or tongue on its free edge. The tab may be interfitted into the slot to hold the flaps closed. The ends of a piece of formed wire are inserted through and attached to portions of the folded cardboard to constitute a handle for the container and to maintain the container in its folded condition.

The slope of the side walls of such folded cardboard food containers has traditionally been approximately 6° away from the vertical major axis of the container. Such a 60° slope offers several advantages. Specifically, the 6° slope permits empty folded containers with their flaps unfolded and not covering their openings to be conveniently nested and stacked and thereafter separated for use and storage. Nesting and stacking is achieved by inserting an upper container into a lower container. An angle much smaller than 6° (i.e., about 4°) results in the containers becoming self-locking or jammed together and difficult to separate. A significantly larger angle may render a nested stack of the containers unstable and permit the stack to fall over.

Folded cardboard containers have several disadvantages. First, much of the cardboard which goes into the folded container is "wasted" in that it serves no function other than to permit the container to be folded into a leak-proof unit. Those portions of the folded cardboard to which the ends of the wire handle are usually connected constitute, for the most part, excess cardboard, the elimination of which would constitute a savings.

Second, although the typical cardboard (e.g., SBS or bleached board) used to form folded food containers often includes a moisture-resistant coating, the presence of food in a container for a substantial period time can nonetheless degrade the cardboard; it is not certain that such cardboard containers are suitable for long term storage of food therein. Third, the presence of a wire handle on the container renders these containers generally unsuitable for reheating the contents thereof in certain microwave ovens, the presence of metal in which can cause certain operating difficulties. Fourth, removal of the metal handle—to facilitate microwave heating or for other reasons—permits the cardboard container to unfold and can destroy its leak-proof integrity. Fifth, although the traditional cardboard container, as noted, has its side walls sloped at 6° from the vertical to facilitate nested stacking and removal of containers from the stack, the surface of the cardboard and the ease of forcing together adjacent containers in the stack sometimes renders inconvenient the removal of a single container from the stack for the placement of food therein.

An object of the present invention is the provision of a molded plastic container which meets the criteria of the traditional folded cardboard container, for example, those used for the sale of oriental foods, but which avoids the disadvantages of such prior art containers.

SUMMARY OF THE INVENTION

A container according to the present invention comprises a molded or formed one piece plastic container having a bottom wall and a plurality of integral, contiguous upstanding side walls defining a top opening and a plurality of upper edges. A flap is associated with the upper edge of each of a plurality of the side walls. Living hinge means join one edge of each flap to the upper edge of its associated side wall and is for permitting the flaps to be inwardly folded to overlie and close the opening and fully unfolded to uncover the opening.

In one aspect, there are at least three of the side walls and at least two flaps.

In a further aspect, the side walls are planar and there are four side walls and at least two flaps.

In still a further aspect, there are four flaps, one associated with each side walls.

In a further aspect, two of the side walls and two of the plurality of flaps are in opposing relation, the container including locking means coupled to each of the two opposing flaps for releasably retaining all of the flaps in place in a locked condition after they have been inwardly folded.

In yet another aspect, the locking means comprises a slot in one of the two flaps and a locking member secured to the other of the two flaps, the locking member being arranged to engage the slot and form a handle for the container when engaged while simultaneously locking the flaps in place.

DETAILED DESCRIPTION

Figure 1:
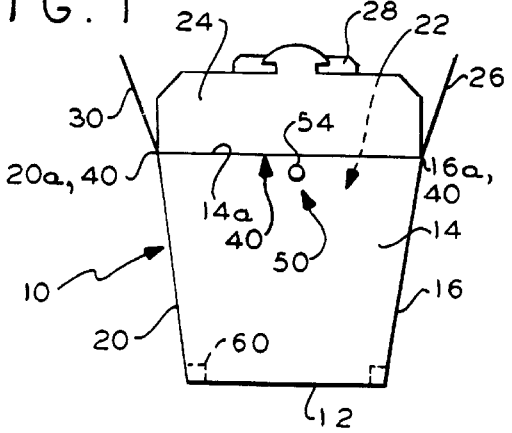
FIG. 1 is a front elevation of a container according to an embodiment of the present invention with closable flaps thereof in an open position.

In FIG. 1, a molded plastic container 10 according to an embodiment of the present invention may comprise a plurality of different moldable or formable plastic materials, including, without limitation, polypropylene, polyethylene, PET or copolymers of the foregoing, and may be formed by a variety of techniques such as injection molding and thermo (or vacuum) forming. The container 10 is described in the aforementioned U.S. Pat. No. 5,489,063 incorporated by reference herein.

Figure 2:
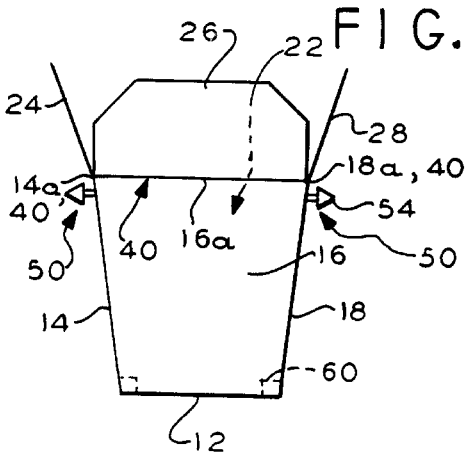
FIG. 2 is a side elevation of the container of FIG. 1.
Figure 3:
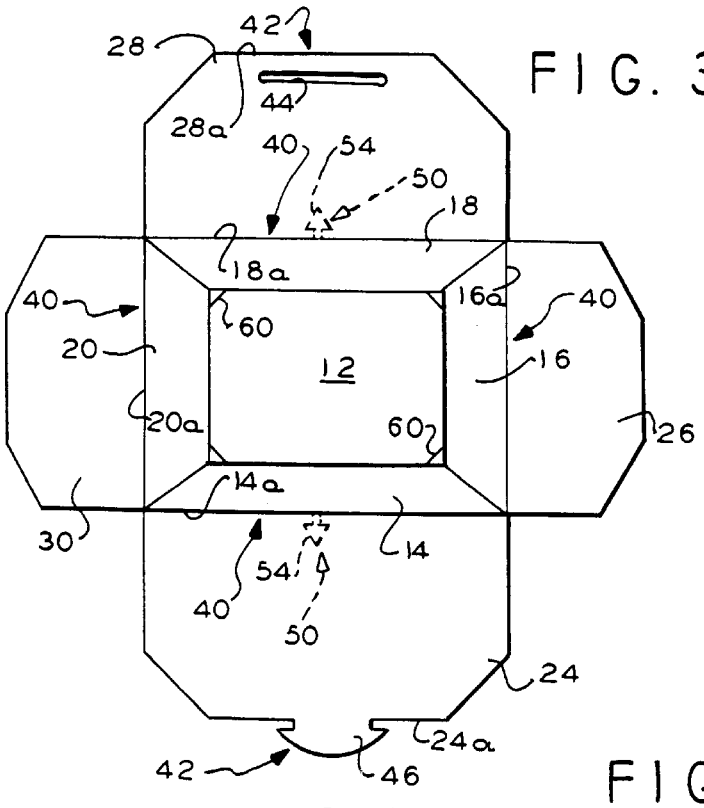
FIG. 3 is a top plan view of the container of FIGS. 1 and 2 with the flaps thereof fully opened.

In FIGS. 1–3, the molded plastic container 10 of the present invention has the general configuration and appearance of typical prior art folded cardboard container of U.S. Pat. No. 1,088,964 used for the storage, sale and off-premises consumption of hot and cold foods such as oriental foods. The container 10 has a generally planar rectangular bottom wall 12 and four integral, contiguous upstanding planar side walls 14, 16, 18 and 20 having respective upper edges 14*a*, 16*a*, 18*a* and 20*a*. The bottom wall 12 may have a depression (not shown) for molding purposes or otherwise. The walls are relatively thin and have a thickness similar to the prior art similar cardboard or paperboard containers.

The side walls define a top opening 22 in communication with the interior cavity volume of the container 10. Associated with the upper edges 14*a*, 16*a*, 18*a* and 20*a* are respective flaps 24, 26, 28 and 30. The flaps are one piece and integral and contiguous with the respective side walls through living hinges.

The flaps 24, 26, 28 and 30 are joined to the edges 14*a*, 16*a*, 18*a* and 20*a* by hinges 40, which are, preferably, so-called living hinges. As is well known, the living hinges 40 constitute decreased thickness portions of molded plastic which permit the flaps 24, 26, 28 and 30 to be pivoted or rotated relative to the respective side walls 14, 16, 18 and 20 to which they are connected. The living hinges 40 permit each flap 14, 16, 18, and 20 to be inwardly folded to overlie and together close the opening 22 and, as shown in FIGS. 1–3, to be fully unfolded to uncover the opening 22. The living hinges 40 are formed during the molding or forming of the container 10 wherein the entire container and flaps are one piece. The flaps individually are smaller in area than the top opening 22, but together, when folded over one another, are juxtaposed with and close the opening.

A flap locking arrangement 42 maintains the flaps 24, 26, 28 and 30 in the folded condition (not shown) after they have been inwardly folded closing the opening 22. Preferably, the flaps 26 and 30 are folded radially inwardly toward one another in overlying relation first and then the flaps 24 and 28 are folded inwardly to overlie the flaps 26 and 30. In FIGS. 1–3, the locking arrangement 42 preferably constitutes a slot 44, which may also be a slit, formed through one flap 28 near its free edge 28*a* and a tab 46 or tongue formed integral and contiguous with as one piece therewith and extending from the free edge 24*a* of the diametrically opposed flap 24. The tab 46 has two opposing slots adjacent to the flap 24 edge 24*a* to engage and lock to the flap 28 after the tab is inserted into the slot 44. The locking member or tab 46 is arranged to engage and pass through the slot 44. The tab 46 terminates in terminal undercut extensions. Sufficient insertion of the locking member into the slot 44 causes the extensions to engage and be momentarily deformed by the termini edges of the slot 44, following which continued insertion of the tab 46 permits the extensions to become undeformed to engage and lock to the surface of the slot-containing flap adjacent the slot termini.

As noted, the two flaps 26 and 30 are first folded inwardly to partially close the opening 20 and then following inward folding of the flaps 24 and 28, the tab 46 is inserted into the slot 44 to retain all of the flaps folded over the opening 22. Other locking arrangements, such as a differently shaped tab and/or slots or interlocking tabs, may also be employed.

For example, such different locking arrangements may include the locking arrangement of FIGS. 7 and 8 to be described below herein.

Figure 4:
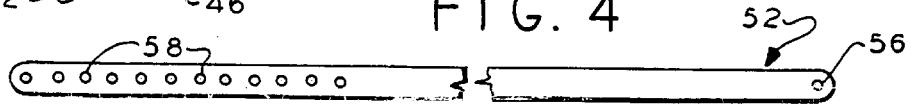
FIG. 4 is plan fragmented view of a strap which may be used with the container of FIGS. 1–3.

A locking stud 50 is on opposed side walls, preferably on walls 14 and 18 with which the flaps 24 and 28 are respectively associated. The stud 50 is employed to mount a strap 52 (FIGS. 4–6) to the container 10. The studs 50 each preferably includes an arrowhead type conical or tapered projection 54 extending from a cylindrical shank attached to and extending from the respective side wall 14 and 18. The projection 54 extends away from the side walls 14 and 18 near the upper edges 14*a* and 18*a* thereof.

Figure 5:
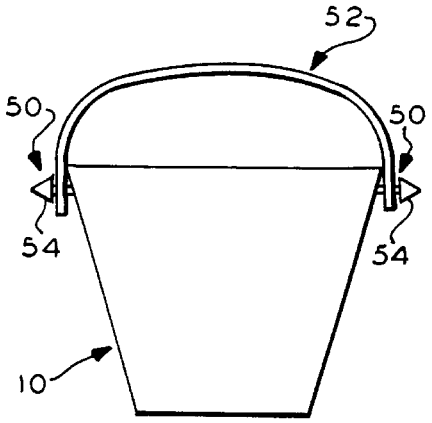
FIGS. 5 and 6 are side elevation views of the container of FIG. 1 with the strap of FIG. 4 attached as a handle, FIG. 5, or as a flap hold-down, FIG. 6.

The strap 52 preferably is molded thermoplastic having a single hole 56 at one end thereof and a plurality or series of holes 58 formed at and extending away from the other opposite end of the strap 52. In use, the hole 56 is forced over one projection 54 until the hole 56 resiliently bypasses the head and is retained on the stud 50 shank. Thereafter, as shown in FIG. 5, a hole 58 at or near the other end of the strap 52 may be similarly placed over the stud 50 projection 54 on the opposite side wall so that the strap 52 assumes the configuration of a carrying handle, FIG. 5.

Figure 6:
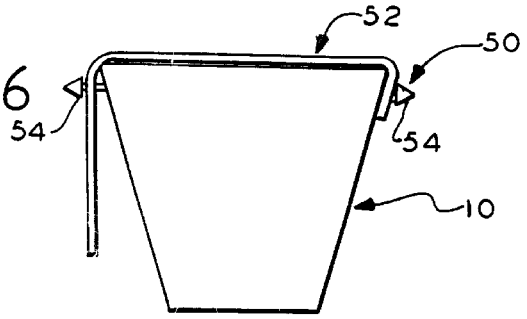

In FIG. 6, the strap 52 may also serve the function of a flap hold-down. Specifically, after placing the hole 56 over one stud 50 projection 54, a hole 58 remote from the other end of the strap may be placed over the other stud 54 so that the strap 52 conforms to and holds down the inwardly folded flaps 24, 26, 28 and 30 of the container 10.

The strap 52 may be affixed to the studs 50 by the manufacturer or supplier or, as is preferable, by the end user, in which latter event containers 10 and straps 52 are supplied separately and disassociated. The studs 50 may have other configurations or may be replaced by functionally equivalent members, such as hooks or the like. Further, if wire handles are deemed to be not disadvantageous, the studs 50 projections 54 may be replaced by a respective hole through each stud 50 shank for attachment thereto of such wire handles.

Molded into the container 10 on the interior of on or more of the side walls 14, 16, 18 and 20 or on the bottom 12 are preferably one or more ledges or stops 60. When the containers 10 are stored prior to use it is preferred that they be nested in stacked relation. To this end, the side walls 14, 16, 18 and 20 of the container 10 may be formed at an angle, preferably approximately 6° relative to the vertical in FIGS. 1 and 2 from the top to bottom of the drawing figure. The handle-mounting studs 50 (or their functional equivalents) and the ledges 60 ensure that a containers 10 may be conveniently removed from the nested stack.

When a first container 10 is placed within a second container 10, following a certain amount of insertion, the studs 50 on the opposed walls 14 and 18 contact the edges 14*a* and 18*a* of the container 10 into which the first container 10 is inserted. This engagement limits the amount of inward insertion of the first container 10 into the second container 10 to that which permits the inserted container to be later easily removed-without jamming or self-locking. Similarly, the bottom of the first inserted container preferably engages the ledges 60 at approximately the same time that the studs 50 of the inserted container 10 engage the edges 14*a* and 18*a* of the second container. It should be clear that the studs 50 alone or the ledges 60 alone may serve the function of limiting insertion of the nested containers 10 into each other in a stack of containers 10 to permit convenient removal thereof. It is preferred, however, that both be present.

Figure 7:
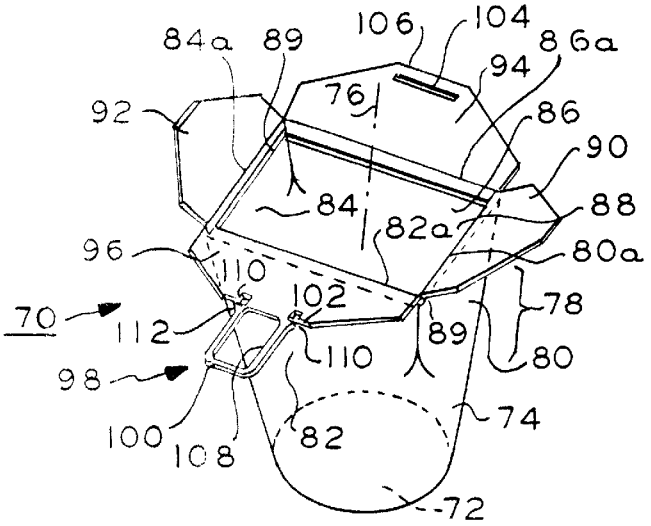
FIGS. 7 and 8 are perspective views of two further embodiments of a container according to the present invention with the flaps thereof fully open similar to the flap orientation of the container of FIG. 3.

In FIG. 7, container 70 in a further embodiment comprises a preferably planar circular bottom wall 72. A truncated conical side wall 74 is integral with and molded or otherwise formed as a one piece construction with the bottom wall 72. Side wall 74 forms a truncated conical bottom volume. The side wall 74 preferably tapers relative to the vertical axis 76 from the top to bottom of the container at an angle of about 6° to permit nesting of the containers 70 as discussed above in connection with container 10.

An upper portion 78 of side wall merges into four opposing planar side walls 80, 82, 84 and 86 terminating in a preferably square or rectangular opening 88 at the container 70 top. The planar side walls are integral, contiguous and formed as one piece with the side wall 74. The planar side walls form a polygon upper volume contiguous with the lower volume. This container would be similar to a solid object that was initially square in cross section and truncated. The bottom section portion would then be reduced in diametrical dimension by forming this section into a truncated conical section. The junction between the planar side walls and the conical section are rounded and gradual so no line of demarcation is present therebetween.

The opening 88 may also have other polygon shapes, three, five, six or more sides for example, according to a given implementation. The side walls 80, 82,84 and 86 each gradually curve and terminate at a respective upper linear edge formed into respective linear living hinges 80*a*, 82*a*, 84*a* and 86*a*.

Flaps 90, 92, 94 and 96 are connected to respective hinges 80*a*, 84*a*, 86*a* and 88*a*. The flaps 90, 92, 94 and 96, the associated hinges, the associated side walls and bottom wall are formed or molded as a one piece plastic structure of generally uniform thickness except for the living hinges which are reduced thickness to permit the hinge function. Preferably opposite flaps 90 and 92 are of generally the same peripheral dimensions. Opposite flaps 94 and 96 are also preferably of the same peripheral dimensions.

An outwardly extending step 89 forming an upwardly facing shoulder is formed in each side wall adjacent to the corresponding hinge 80*a*, 82*a*, 84*a* and 86*a*. The step 89 is present on the interior and external surfaces of the side walls. The step 89 permits stacked nesting of the containers 70 as the ledges 60 in the embodiment of FIGS. 1 and 2.

The external portion of the step 89 of an inner nested container rests on the living hinges of the outer nested container to preclude wedged jamming of the nested containers. The steps extend for the length of each living hinge and do not damage the hinges because the weight of the stacked containers is distributed over the length of the hinges.

The flaps 90, 92, 94 and 96 enclose the opening 88 in overlying relation when folded radially inwardly toward one another. A locking arrangement 98 releasably secures the flaps closed. The arrangement 98 includes a tab loop member 100 extending from edge 102 of flap 96 distal hinge 82*a* and a slot 104 adjacent to edge 106 of flap 94 distal hinge 86*a*. The loop member serves as a locking arrangement and as a handle for the container.

The loop member 100 defines an opening 108. A pair of slots 110 are between the member 100 and edge 102 forming a locking projection 112 on opposite sides of the member 100. The locking projections 112 comprise outwardly tapered flared portions for forming the slots 110. The member 100 forms a locking tab by insertion of the member 100 through the slot 104 in flap 94, the projections 112 engaging and locking to the flap 94. The loop member 100 serves as a locking tab releasably retaining and locking the flaps closed. No handle securing projections such as projections 54 of the embodiment of FIG. 2 are needed.

The loop member 100 when inserted through the slot 104 projects substantially beyond the flap 94 in the closed condition. The loop member 100 is upright and extends generally along axis 76 away from the container 70 when the flaps are closed and locked. Loop member 100 thus also forms a handle for the container 70. No further handle or strap is required to either hold the flaps closed or to provide a carrying structure for the filled container, which may be filled with hot food. The loop member 100 is sufficiently large to permit one or more fingers of a person to pass therethrough for safely carrying the container. The container 70 is formed as a one piece integral molded or formed structure with all walls and flaps and the loop member contiguous as shown.

The loop member while generally looped and elongate may be other shapes. Since the projections 112 lock to the flap 94 at slot 104, the remainder of the loop member need only be dimensioned and shaped to pass through the slot 104. By making the loop member sufficiently flexible by reason of its thickness and flexibility of its material from which it is formed, it can be folded to pass through the slot 104 and then unfolded into a relatively large handle. The slot can be shaped and dimensioned accordingly.

By way of example, the loop member may be a solid tab like member similar to the tab 46 of FIG. 3, but relatively more elongate to serve as a convenient handle. In a further example, the loop member may be formed as a tether like device, e.g., an elongate strap whose end distal the projections 112 remains unattached to the container but useful for grasping as a handle.

By way of further example, the loop member may be a circular or polygon in transverse section cylindrical, but pliable tether (not shown) extending from projections 112. The slot 104 may have a central enlarged opening (not shown) shaped to permit the tether to pass therethrough. Once the projections are releasably locked to the slot, the enlarged central opening has no significant effect on the locking action of the projections which are at opposing edges of the slot distal the central opening. In the alternative, the locking projections may comprise a conical section tapering outwardly at the base of the tether where attached to a flap.

Figure 8:
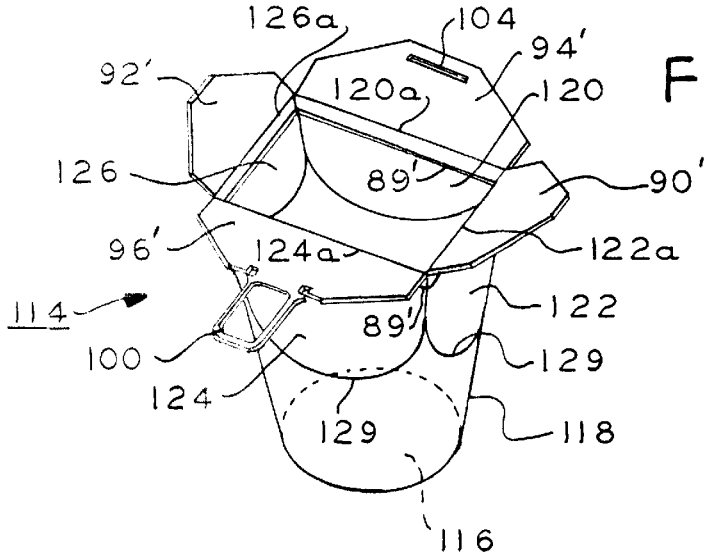

In FIG. 8, a container 114 according to a further embodiment includes a preferably circular planar bottom wall 116 and an upstanding truncated conical side wall 118 similar to the side wall 74 of the container 70, FIG. 7. The annular tapered side wall 118 is formed into four planar side walls 120, 122, 124 and 126. The side walls each have a line of demarcation 129 separating the planar side walls from the conical side wall 118. The line of demarcation is present because in this case the planar side walls are formed as if the container was originally a tapered conical segment from top to bottom and the planar side walls formed by reducing the diameter of the conical portion at the upper end of the container. Thus this container 114 is somewhat similar to the container 70, FIG. 7.

Flaps 90', 92', 94' and 96' which may be identical to flaps 90, 92, 94 and 96 of FIG. 7, are connected to the respective side walls 122, 126, 120 and 124 by respective corresponding living hinges 122*a*, 126*a*, 120*a* and 124*a*. Hinges 120*a*, 122*a*, 124*a*, and 126*a* extend for the full extent of the junction between the corresponding side wall and flap as do all of the hinges in the various embodiments disclosed herein. However, the hinges may extend partially along each flap with the remaining portion of the junction of each flap and corresponding side wall spaced by a slot (not shown).

A step 89' is formed in the planar side walls similar to step 89, FIG. 7. This step is for the same purpose, i.e., to permit stacking in nested relation of the containers 114 without wedging of the nested containers.

A handle member 100 is secured to flap 96' and a slot 104 is formed in the flap 94' to receive the member 100 as described above in connection with the FIG. 7 embodiment.

Figure 9:
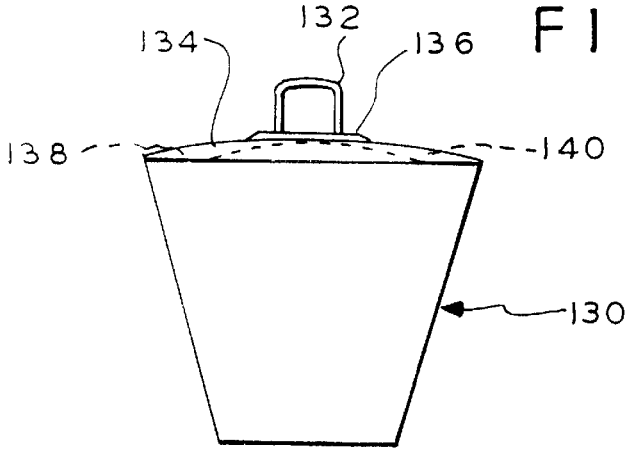
FIG. 9 is a side elevation view of a further embodiment of the container of FIG. 1 employed with the handle of the embodiment of FIGS. 7 and 8.

In FIG. 9, a further embodiment includes a container 130 which is substantially identical to the container of FIG. 1 except the studs 50 and projections 54 are omitted. The side walls and living hinges of container 130 are identical to those of container 10 of FIGS. 1–2. A further exception, is that a handle loop member 132 identical to the loop member 98 of FIG. 7 is attached to the free edge of flap 134. The opposing flap 136 is identical to flap 28, FIGS. 1–3. Flap 136 has a slot (not shown) through which the handle loop member 132 is passed. Four flaps 134, 136, 138 and 140 are employed in the container 130, each hinged to a corresponding sidewall.

In a further embodiment (not shown), the flaps may be dimensioned so as to overlap one another in interlocking overlying relation without the need for further locking tabs or structure. For example, the flaps may each overly one another and the opening of the container an extent so that by bending the flaps at corners thereof, the corners may be manually forced over and under one another to form a releasable locking arrangement.

Those skilled in the art will appreciate that changes to the embodiments described herein, which are given by way of illustration and not limitation, may be made without departing from the spirit and scope of the following claims. For example, a square or rectangular container is illustrated with four flaps. However, the container may be triangular in plan view and may have a flap associated with only two of the three side walls. Also, two flaps may be associated with four or more side walls, as long as the flaps are dimensioned to close the container opening. In this case two living hinges are provided. Also, three flaps or more flaps may also be provided with a four or more sided container.

We claim:

1. A container, comprising:

a molded one piece plastic container having a bottom wall and a plurality of integral, contiguous upstanding side walls defining a top opening and a plurality of upper edges;

a flap associated with the upper edge of each of a plurality of said side walls;

living hinge means for joining one edge of each flap to the upper edge of its associated side wall and for permitting the flaps to be inwardly folded to overlie and close the opening and fully unfolded to uncover the opening;

two of said side walls and two of said plurality of flaps being in opposing relation; and locking means coupled to each said two opposing flaps for releasably retaining said flaps in place in a locked condition after they have been inwardly folded;

said locking means comprising a slot in one of said two flaps and a locking member secured to the other of said two flaps for engaging the slot and forming a handle for the container when engaged while simultaneously locking said flaps in place.

2. The container of claim 1 wherein there are at least three of said side walls and at least two of said flaps.

3. The container of claim 1 wherein said side walls are planar and there are four side walls and at least two flaps.

4. The container of claim 3 including four flaps, one associated with each side wall.

5. The container of claim 1 wherein the locking member comprises an elongated member having a configuration and length arranged to be manually grasped as a handle when passed through said slot.

6. The container of claim 1 wherein the locking member is a loop.

7. The container of claim 1 including a conical truncated side wall upstanding from, integral and one piece with said bottom wall forming a truncated conical bottom volume and said plurality of side walls are planar and form a polygon in cross section upper volume contiguous with said bottom volume.

8. The container of claim 1 further including step means formed on the exterior of the container for limiting insertion of one container into the interior of a second container in nested relation by abutment of the step means with and substantially along the length of a corresponding one said upper edges.

9. The container of claim 1 wherein said slot has opposing termini edges, said locking member being arranged to pass through the slot, said locking member terminating in terminal undercut extensions, sufficient insertion of the locking member into the slot causing the extensions to engage and be resiliently deformed by the termini edges of the slot, following which continued insertion permits the extensions to return to the undeformed condition to engage the surface of the slot-containing flap adjacent the slot termini.

10. A container, comprising:

a molded or one piece plastic container having a bottom wall and at least three integral, contiguous upstanding side walls defining a top opening and a plurality of upper edges, each side wall having a corresponding upper edge;

a flap associated with the upper edge of each of a plurality of said side walls, said flaps being dimensioned to cooperate to close the opening in overlying relation with the opening, two of said flaps being in opposing relation;

living hinge means for joining one edge of each flap to the upper edge of its associated side wall and for permitting the flaps to be inwardly folded to overlie and close the opening and fully unfolded to uncover the opening; and locking means comprising a slot in one of said two flaps and a locking member secured to a second of said two flaps, said locking member including a portion for passing through the slot and forming a handle for said container when the flaps are closed.

11. The container of claim 10 including four side walls upstanding from the bottom wall, each side wall having associated therewith a flap, each flap being connected to its associated side wall by a living hinge.

12. The container of claim 10 including four side walls upstanding from the bottom wall, at least two of said side walls having associated therewith a flap, each flap being connected to its associated side wall by a living hinge.

13. The container of claim 12 wherein each said side walls has a flap associated therewith, each flap being connected to its associated side wall by a living hinge.

14. A container, comprising:

a molded or formed one piece plastic container having a bottom wall and a plurality of integral, contiguous upstanding side walls defining a top opening and a plurality of upper edges;

a flap associated with the upper edge of each of a plurality of said side walls; and living hinge means for joining one edge of each flap to the upper edge of its associated side wall and for permitting the flaps to be inwardly folded to overlie and close the opening and fully unfolded to uncover the opening;

two of said side walls and two of said plurality of flaps being in opposing relation, said container including locking means coupled to each said two opposing flaps for releasably retaining all of said flaps in place in a locked condition after they have been inwardly folded;

said locking means comprising a slot in one of said two flaps and a locking member secured to the other of said two flaps, said locking member being arranged to engage the slot and form a handle for the container when engaged while simultaneously locking said flaps in place.

* * * * *